US009728898B1

(12) United States Patent
Johnson

(10) Patent No.: US 9,728,898 B1
(45) Date of Patent: Aug. 8, 2017

(54) CONDUCTIVE SHELL FOR A CABLE ASSEMBLY

(71) Applicant: Microsoft Technology Licensing, LLC, Redmond, WA (US)

(72) Inventor: David Johnson, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/012,756

(22) Filed: Feb. 1, 2016

(51) Int. Cl.
*H01R 13/648* (2006.01)
*H01R 13/6581* (2011.01)
*H01R 43/18* (2006.01)

(52) U.S. Cl.
CPC ..... *H01R 13/6581* (2013.01); *H01R 43/18* (2013.01)

(58) Field of Classification Search
CPC ..... H01R 13/6581
USPC ..... 439/607.27
See application file for complete search history.

(56) References Cited

U.S. PATENT DOCUMENTS 5,244,415 A * 9/1993 Marsilio ..... H01R 9/032 439/456
5,250,756 A 10/1993 Swift et al.
5,691,251 A 11/1997 Skopic
6,601,296 B1 8/2003 Dailey et al.
6,935,896 B1 * 8/2005 Tsai ..... H01R 13/506 439/541.5
7,114,956 B2 10/2006 Kreitzer et al.
7,160,153 B1 1/2007 Huang
7,249,974 B2 7/2007 Gordon et al.
7,485,013 B2 * 2/2009 Kuo ..... H01R 9/03 439/731
7,841,885 B2 11/2010 Schmitt et al.
8,231,400 B2 7/2012 Phillips et al.
8,439,706 B2 5/2013 Sytsma et al.
8,834,185 B2 9/2014 Wu
2006/0121783 A1 * 6/2006 Wu ..... H01R 9/032 439/607.41
2008/0050950 A1 2/2008 Wu et al.
2008/0050951 A1 * 2/2008 Wu ..... H01R 13/2442 439/108
2008/0132116 A1 * 6/2008 Wu ..... H01R 27/00 439/607.17

(Continued)

FOREIGN PATENT DOCUMENTS

CN 201608332 10/2010
CN 105119087 2/2015
CN 103579862 7/2015

OTHER PUBLICATIONS

Williams, Tim, "EMC for Product Designers", In Publication of Newnes, Apr. 11, 2007, 5 pages.

(Continued)

*Primary Examiner* — Abdullah Riyami
*Assistant Examiner* — Nader Alhawamdeh
(74) *Attorney, Agent, or Firm* — Schwabe, Williamson & Wyatt P.C.

(57) ABSTRACT

A cable assembly includes a connector head and a conductive shield arranged to at least partially encase the connector head. The conductive shield includes a first plurality of contact members. A conductive shell is arranged to at least partially encase the connector head and the conductive shield. Each of the first plurality of contact members extends outwardly from the conductive shield toward the conductive shell to electrically couple the conductive shield to the conductive shell.

18 Claims, 9 Drawing Sheets

(56) References Cited

U.S. PATENT DOCUMENTS

2009/0197459 A1* 8/2009 Yu ..... H01R 4/027 439/497
2009/0203266 A1* 8/2009 Chuang ..... H01R 13/6666 439/701
2010/0062653 A1* 3/2010 Mao ..... H01R 12/712 439/660
2010/0068934 A1* 3/2010 Li ..... H01R 13/627 439/607.55
2011/0195593 A1 8/2011 McGrath et al.
2011/0195609 A1* 8/2011 Su ..... H01R 4/2433 439/660
2011/0256756 A1* 10/2011 Lu ..... H01B 7/0892 439/449
2011/0281465 A1* 11/2011 Hou ..... H01R 13/6581 439/607.55
2011/0300749 A1* 12/2011 Sytsma ..... H01R 13/65802 439/607.01
2012/0064758 A1* 3/2012 Grice ..... H01R 13/641 439/490
2012/0164886 A1* 6/2012 Ko ..... H01R 13/6658 439/626
2013/0130549 A1 5/2013 Wu et al.
2013/0288541 A1 10/2013 Nagamine
2014/0141647 A1 5/2014 Do et al.
2015/0044911 A1* 2/2015 Wu ..... H01R 43/20 439/620.22
2015/0126068 A1 5/2015 Fang et al.
2015/0207254 A1 7/2015 Kamei et al.
2017/0070015 A1 3/2017 Chen

OTHER PUBLICATIONS

European Patent Office (ISA); International Search Report and Written Opinion, PCT/US2017/013637; mail date Mar. 22, 2017; 16 Pages.

* cited by examiner

CONDUCTIVE SHELL FOR A CABLE ASSEMBLY

BACKGROUND

The popularity of high-definition, multi-channel audio and video has grown rapidly. Electromagnetic interference (EMI) radiation resulting from the operation of an electronic device including the transmission of high-definition, multi-channel audio and video data, may disrupt, impede, or otherwise degrade operation of surrounding electronic devices. As a consequence, the United States and other foreign jurisdictions highly regulate EMI radiated from electronic devices during operation.

BRIEF DRAWINGS DESCRIPTION

The present disclosure describes various embodiments that may be understood and fully appreciated in conjunction with the following drawings.

SUMMARY

Figure 1:
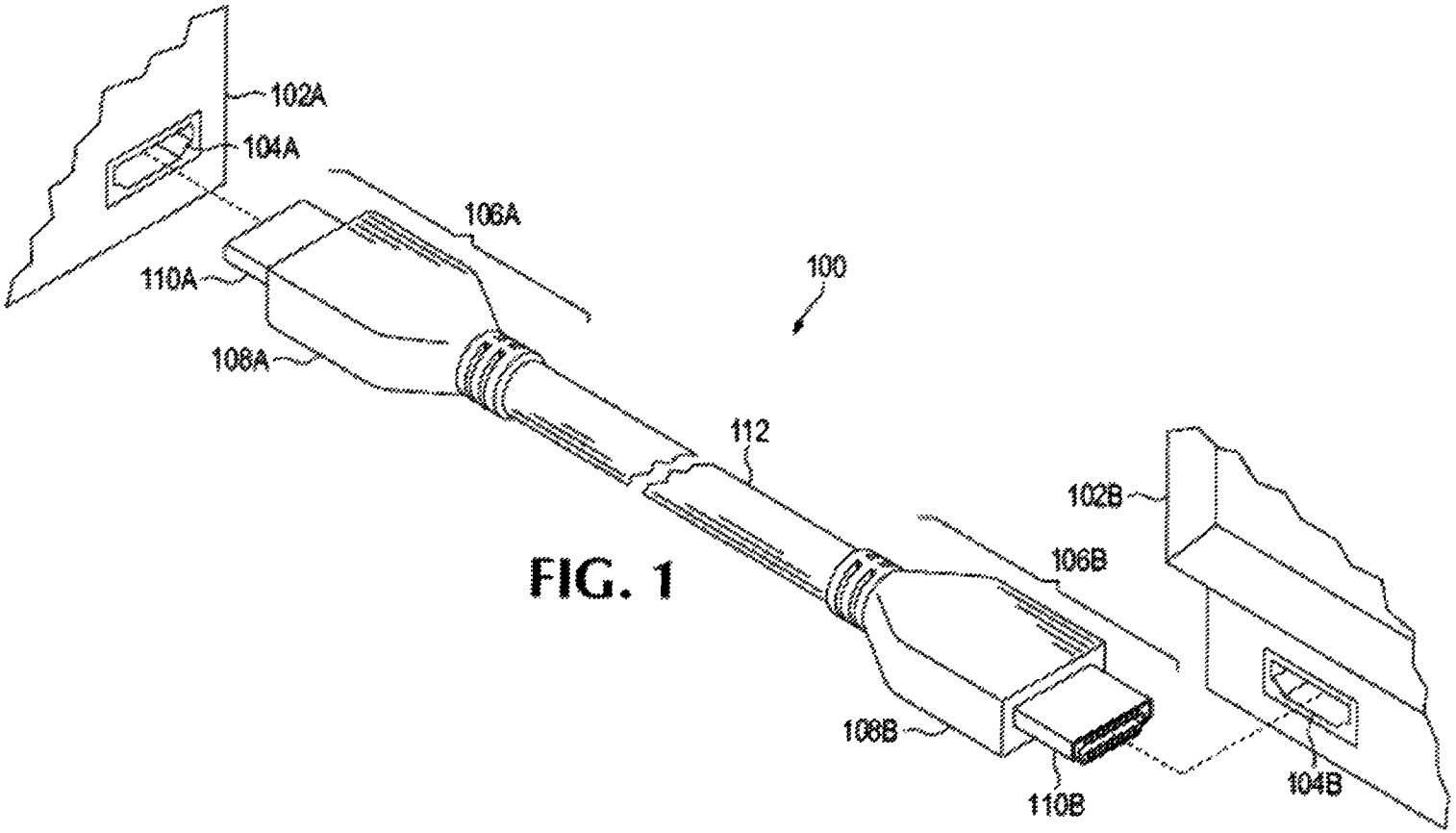
FIG. 1 is a perspective view of an embodiment of a cable assembly according to the present disclosure.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A cable assembly may include a conductive shield with a first plurality of contact members and a conductive shell arranged to at least partially encase the conductive shield. Each of the plurality of contact members may extend outwardly from the conductive shield toward the conductive shell to electrically couple the conductive shield to the conductive shell.

A cable assembly may include a connector head, a conductive shield arranged to at least partially encase the connector head having a plurality of perforations on a top face, and a conductive plastic having a first liquid phase during which the conductive plastic is substantially liquid and a second solid phase during which the conductive plastic is substantially solid. The conductive shield may be arranged to receive the conductive plastic during the first liquid phase through the plurality of perforations. The conductive shield may be arranged to at least partially encase the connector head and the conductive plastic during the second solid phase.

A method may include coupling a plurality of wires bundled by a cable to a connector head and arranging a plurality of cantilevered spring arms having a substantially S-shape on a conductive metal shield, the plurality of cantilevered spring arms extending outwardly from the conductive metal shield. The method may further include substantially encasing at least a portion of the connector head with the conductive metal shield and substantially encasing at least a portion of the connector head and the conductive metal shield with a conductive plastic shell to thereby bring the conductive plastic shell into contact with the plurality of cantilevered spring arms to electrically couple the conductive metal shield to the conductive plastic shell.

DETAILED DESCRIPTION

The present disclosure describes embodiments with reference to the drawing figures listed above. Persons of ordinary skill in the art will appreciate that the description and figures illustrate rather than limit the disclosure and that, in general, the figures are not drawn to scale for clarity of presentation. Such skilled persons will also realize that many more embodiments are possible by applying the inventive principles contained herein and that such embodiments fall within the scope of the disclosure which is not to be limited except by the claims.

Certain embodiments of the present disclosure relate to cable assemblies having electrical connectors used to couple electronic devices. Many electronic devices such as smartphones, media players, and tablet computers may use cable assemblies that facilitate battery charging or communication with other electronic devices. The cable assemblies may include connectors having a plurality of electrical contacts through which electrical connections are made to other compatible connectors to transfer power or transmit data. The cable assemblies may transmit data signals using a variety of communication and interface standards well-known to a person of ordinary skill in the art.

An existing cable assembly intended for the transmission of high-definition multi-channel audio and video data is based on the High Definition Multimedia Interface (HDMI). Cable assemblies used in the transmission of HDMI audio and video data may face challenges meeting EMI regulatory or compliance requirements particularly at high clock and data speeds.

FIG. 1 is a perspective view of an embodiment of a cable assembly 100 according to the present disclosure. Referring to FIG. 1, cable assembly 100 may include a first end 106A and a second end 106B with a cable 112 therebetween. First end 106A may include an insulating overmold 108A. Similarly, second end 106B may include an insulating overmold 108B. Overmold 108A and 108B may provide electrical insulation, mechanical rigidity, and damage protection to cable assembly 100. Overmold 108A and 108B may comprise any insulating material known to a person of ordinary skill in the art, e.g., rubber, plastic, and the like. Overmold 108A or 108B may have any shape appropriate for its intended application. Overmold 108A or 108B may have a shape coincident with the communication and interface standards that they support.

In some embodiments, a connector head 110A may extend or protrude outwardly from overmold 108A where connector head 110A comprises a male or plug-type connector. Connector head 110A may be received by a female or receptacle-type connector 104A on an electronic device 102A. Similarly, a connector head 110B may extend or protrude outwardly from overmold 108B where connector head 110B is a male or plug-type connector. Connector head 110B may be received by a female or receptacle-type connector 104B on an electronic device 102B.

A person of ordinary skill in the art should recognize that electronic devices 102A and 102B may be any known electronic devices, e.g., general purpose or personal computers, hand-held devices, mobile communication devices, gaming devices, music devices, photographic devices, multi-processor systems, microprocessor-based or programmable consumer electronics, minicomputers, mainframe computers, application specific integrated circuits, and like.

Cable assembly 100 is shown with connector heads 110A and 110B that are male or plug-type connectors at both first end 106 and second end 106B, respectively. In other embodiments, however, connector heads 110A or 110B, or both connector heads 110A or 110B, may be female or receptacle-type connectors as is well known to a person of ordinary skill in the art.

Connector heads 110A or 110B may be any type of connector, male or female, that supports any kind of known communication or interface standard, e.g., HDMI, Universal Serial Bus (USB), Firewire, Thunderbolt, Digital Video Interface (DVI), or the like.

Figure 2A:
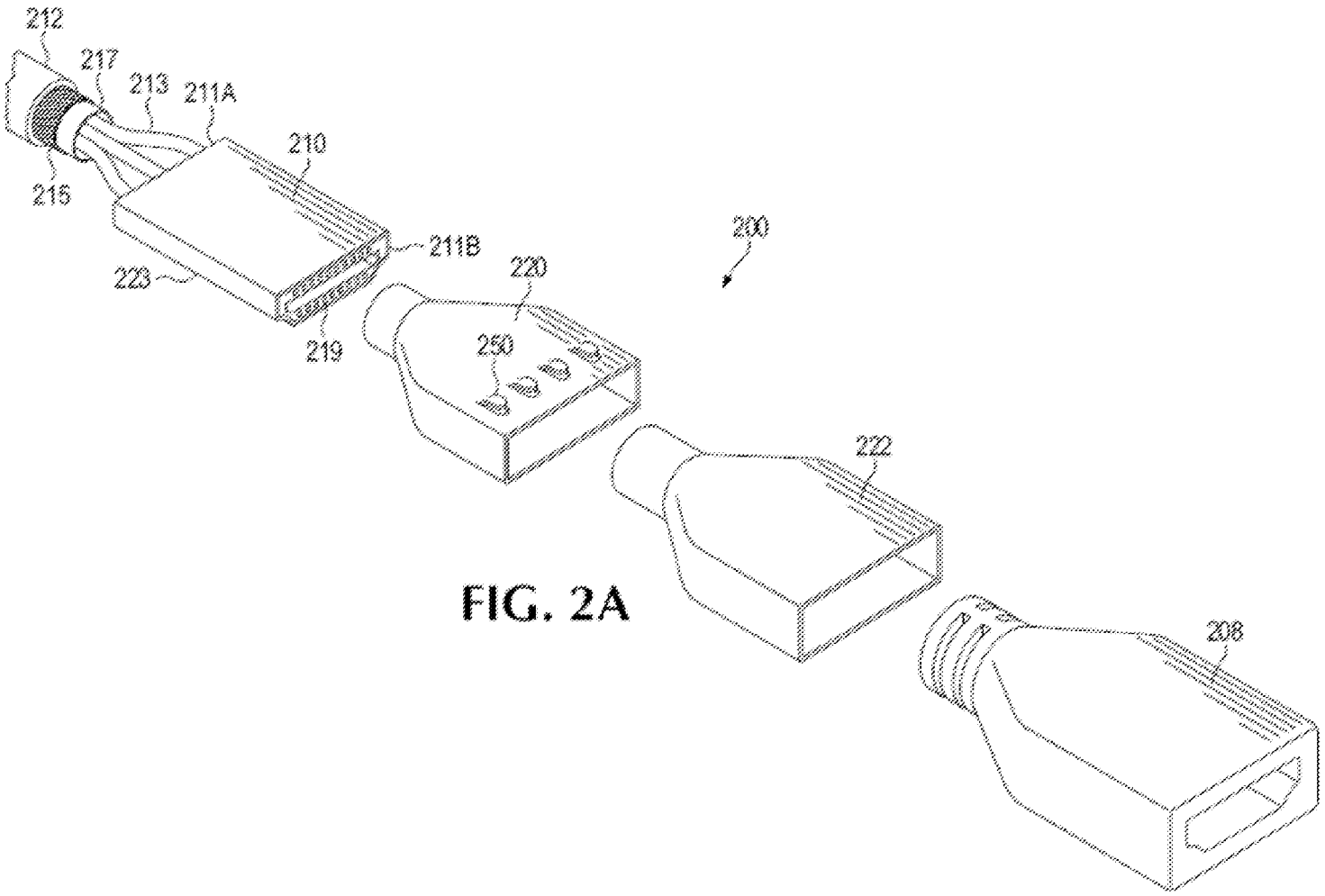
FIGS. 2A-2D are exploded views of an embodiment of a cable assembly according to the present disclosure.
Figure 2B:
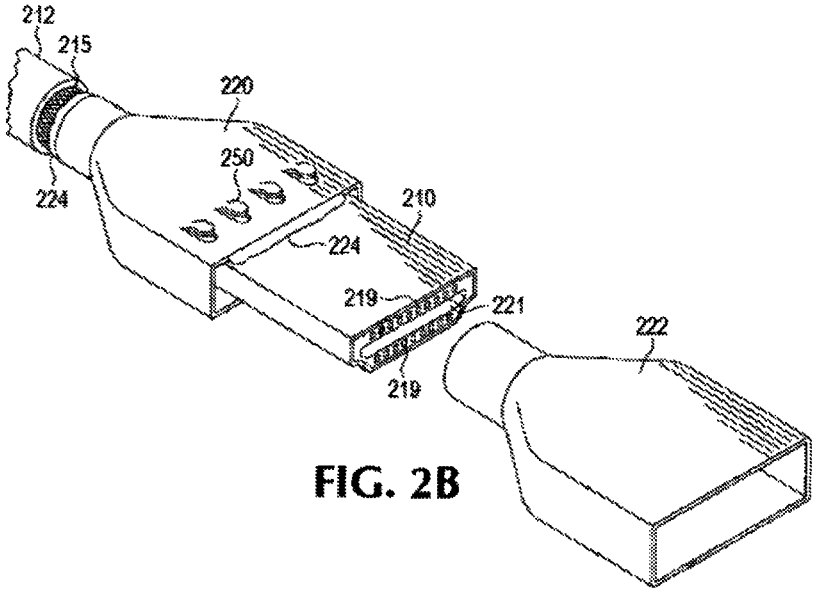
Figure 2C:
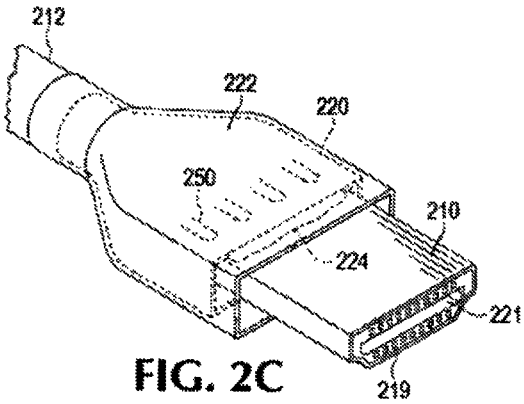
Figure 2D:
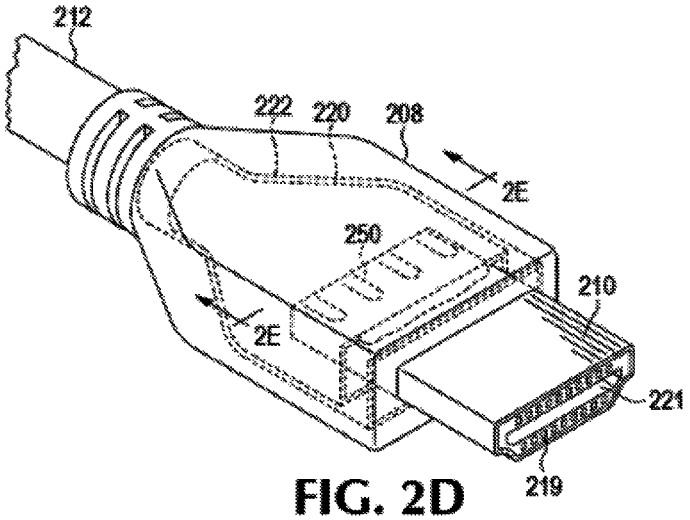
Figure 2E:
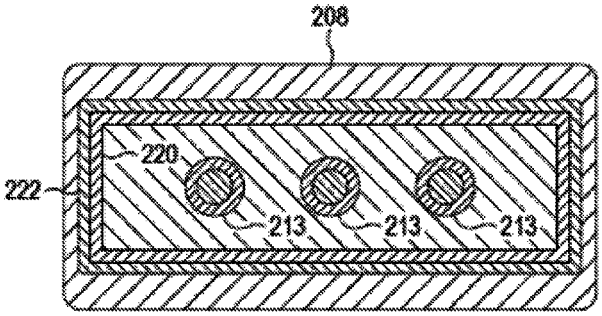
FIG. 2E is a cross-sectional view taken along lines 2E-2E in FIG. 2D of an embodiment of the cable assembly according to the present disclosure.

FIGS. 2A-2D are exploded views of an embodiment of a cable assembly 200 according to the present disclosure. FIG. 2E is a cross-sectional view taken along lines 2E-2E in FIG. 2D of an embodiment of the cable assembly according to the present disclosure. Referring to FIGS. 1 and 2A-2E, cable assembly 200 includes a connector head 210 having a rear portion 211A and a front portion 211B. Rear portion 211A may receive a plurality of wires 213 bundled in cable 212 as is well known to a person or ordinary skill in the art. The number and type of wires included in the plurality of wires 213 varies based on well-known cable design characteristics and parameters, including the type of communication or interface standard supported by assembly 200. A mating connector, e.g., connectors 104A or 104B, may receive front portion 211B of connector head 210 in a circumstance where connector head 210 is a plug or male-type connector. Connector head 210 may include conductors 219 arranged around a top and a bottom of an opening 221. Connector head 210 may include a metal body 223 to provide EMI shielding and mechanical rigidity to at least conductors 219 and opening 221 as is well known to a person of ordinary skill in the art. In some embodiments, connector head 210 may be an HDMI-type connector. A person of ordinary skill in the art will recognize that connector head 210 may include any known connector heads that support any known communication or interface standards, e.g., USB, Firewire, Thunderbolt, DVI, or the like.

Further, each of the plurality of wires 213 may include an insulating cover (not shown separately from wires 213) comprising any insulating material known to a person of ordinary skill in the art, e.g., plastic, rubber, or the like. Cable 212 may optionally bundle the plurality of wires 213 with an insulating sheath 217 comprising any insulating material known to a person of ordinary skill in the art, e.g., plastic, rubber, or the like. Cable 212 may further include a conductive cable shield 215 arranged to prevent EMI radiating or emanating from the plurality of wires 213 bundled in cable 212. Cable shield 215 may have any form, e.g., tubular, and comprise any material, e.g., conductive metallic braid, known to a person of ordinary skill in the art.

A shield 220 may at least partially encase connector head 210 once manufactured as part of cable assembly 200. In some embodiments, shield 220 may extend or overlap rear portion 211A of connector head 210 and extend over cable 212 to provide EMI shielding. A potting compound 224 may be added to fill any gaps between connector head 210 and shield 220 or between cable 212 and shield 220 to provide protection against moisture or corrosive agents or against undesirable mechanical impacts. Potting compound 224 may be any material known to a person of ordinary skill in art, e.g., thermally set plastics, silicone rubber gels, and the like. In some embodiments, shield 220 may be soldered, taped, or otherwise electrically coupled to cable shield 215 to prevent EMI radiation from cable assembly 200. Shield 220 may be soldered, taped, or otherwise electrically coupled to cable shield 215 using any means known to a person of ordinary skill in the art, e.g., conductive solder, conductive tape, copper tape, or the like.

Shield 220 may comprise any substantially rigid conductive material, e.g., aluminum, stainless steel, or the like. In some embodiments, shield 220 may be stamped out of thin gauge sheet or rolled metal. In other embodiments, shield 220 may die cast by pouring a conductive, oftentimes metal, material into a reusable mold. Shield 220 may have any shape appropriate for its intended application, e.g., a four-sided rectangular housing having a narrow or tapered end and an open end as shown in FIGS. 1 and 2A-2E.

Shield 220 may comprise a plurality of contact members 250. Each contact member 250 may extend outwardly from shield 220. In an embodiment, the plurality of contact members 250 may be stamped out or otherwise formed out of shield 220. Shield 220 may comprise any conductive material known to a person of ordinary skill in the art, e.g., stamped or sheet metals. Shield 220 may have any shape appropriate for the application in which it will be used. The plurality of contact members 250 include a first plurality of cantilevered spring arms extending outwardly from the conductive shield. In an embodiment, some or all of the plurality of contact members 250 may have a substantially S-shape.

A shell 222 may be arranged to at least partially encase the shield 220 once manufactured as part of cable assembly 200. In some embodiments, shell 222 may extend or overlap a portion of shield 220 on rear portion 211A of connector head 210 as shown in FIG. 2C. In some embodiments, shell 222 may be soldered, taped, or otherwise electrically coupled to cable shield 215 through shield 220 to prevent EMI radiation from cable assembly 200. Shell 222 may be soldered, taped, or otherwise electrically coupled to cable shield 215 through shield 220 using any means known to a person of ordinary skill in the art, e.g., solder, conductive tape, copper tape, or the like.

Shell 222 may comprise any conductive plastic or resin material known to a person of ordinary skill in the art. In some embodiments, shell 222 may comprise conductive plastic or resin materials having electrically conductive fibers, e.g., carbon, stainless steel, or other conductive fibers. Substantially encasing connector head 210 and shield 220 with shell 222 results in reduced EMI radiation and improving immunity to EMI radiation from other nearby electronic devices. Put differently, embedding conductive fibers in shell 222 may prevent unwanted EMI from radiating outward from cable assembly 200 while preventing externally-generated EMI from disrupting data transmission through cable assembly 200.

Shell 222 may have any shape appropriate for its intended application, e.g., a four-sided rectangular housing having a narrow or tapered end and an open end shown in FIGS. 1 and 2A-2E.

An overmold 208 may be arranged to at least partially encase connector head 210, shield 220, shell 222, and cable 212. Overmold 208 may comprise any insulating material known to a person of ordinary skill in the art. In some embodiments, overmold 208 may comprise any molded plastic having a shape that conforms with the shape of shield 220 or shell 222 or both shield 220 and shell 222 to provide mechanical rigidity to cable assembly 200.

Figure 3A:
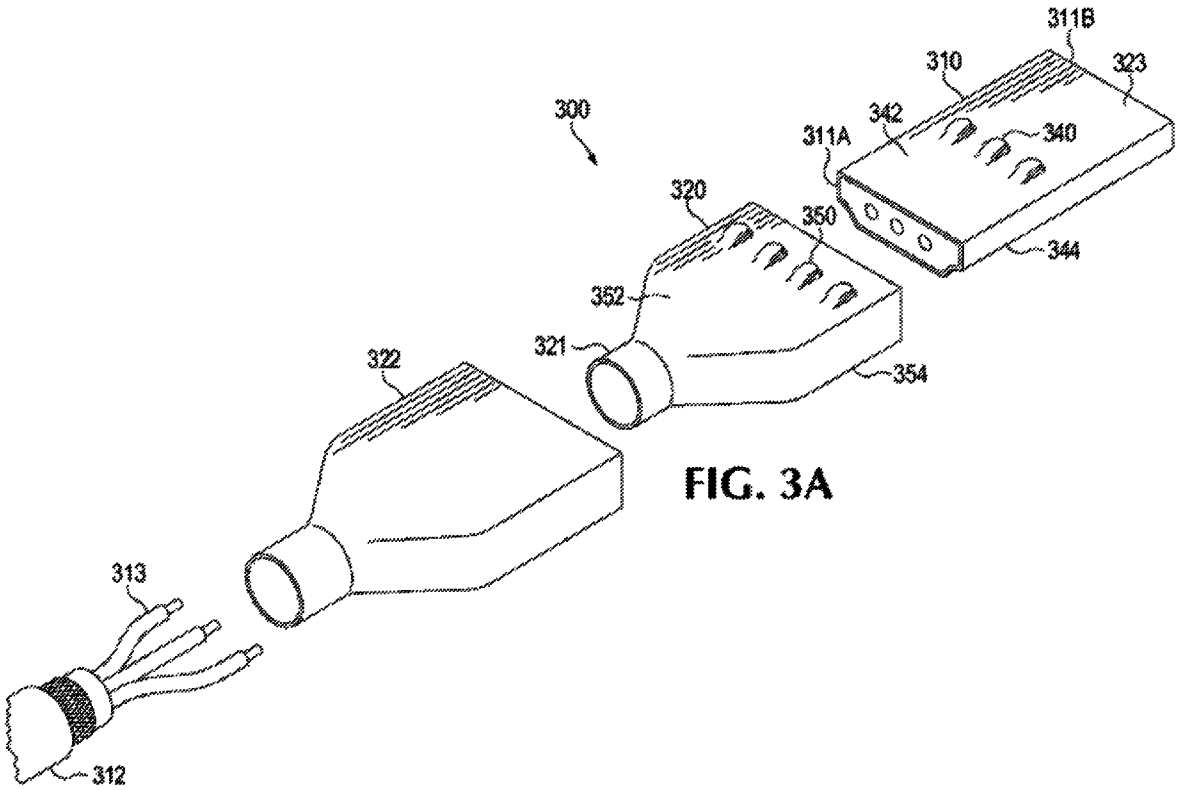
FIG. 3A is an exploded view of an embodiment of a connector head, shield, and shell of a cable assembly according to the present disclosure.

FIG. 3A is an exploded view of an embodiment of a connector head 310, shield 320, and shell 322 of a cable assembly 300 according to the present disclosure. Referring to FIG. 3A, cable assembly 300 may include a connector head 310, a shield 320, and a shell 322. Connector head 310 may include a rear portion 311A and a front portion 311B. Rear portion 311A may receive a plurality of wires 313 bundled in cable 312 as is well known to a person or ordinary skill in the art. The number and type of wires included in the plurality of wires 313 varies based on well-known cable design characteristics and parameters, including the type of communication or interface standard supported by assembly 300. A mating connector (not shown) may receive front portion 311B of connector head 310 in a circumstance where connector head 310 is a plug or male-type connector. Connector head 310 may include an outer shell or metal body 323 to provide EMI shielding and mechanical rigidity as is well known to a person of ordinary skill in the art. Body 323 of connector head 310 may comprise any conductive material known to a person of ordinary skill in the art, e.g., stamped or sheet metals. In some embodiments, connector head 310 may be an HDMI-type plug or male connector. A person of ordinary skill in the art will recognize that connector head 310 may include any known connector heads that support any known communication or interface standards, e.g., USB, Firewire, Thunderbolt, DVI, or the like.

Connector head 310 may have any shape appropriate for its intended application. In the embodiment shown in FIG. 3A, the outer shell of connector head 310 has a rectangular shape with four sides arranged to be substantially encased by shield 320. Connector head 310 may a rear end 311A to receive wires 313 from cable 312.

Shield 320 may include a plurality of contact members 350. Each contact member 350 may extend outwardly from shield 320. In an embodiment, the plurality of contact members 350 may be stamped out or otherwise formed out of shield 320. Shield 320 may comprise any conductive material known to a person of ordinary skill in the art, e.g., stamped or sheet metals. Shield 320 may have any shape appropriate for the application in which it will be used. In the embodiment shown in FIG. 3A, shield 320 has a tapered rectangular shape with four sides arranged to substantially encase connector head 310. Shield 320 may have a tapered collar 321 that once fabricated as part of cable assembly 300, may substantially encase cable 312.

The plurality of contact members 350 may be arranged along a top face 352, a bottom face 354, or both top face 352 and bottom face 354 of shield 320. The plurality of contact members 350 include a first plurality of cantilevered spring arms extending outwardly from the conductive shield. In an embodiment, some or all of the plurality of contact members 350 may have a substantially S-shape.

Once fabricated as part of cable assembly 300, shell 322 may substantially encase at least portions of shield 320 resulting in the plurality of contact members 350 extending outwardly from shield 320 to contact shell 322 to thereby electrically couple the shield 320 to shell 322. By doing so, the plurality of contact members 350 may provide a level of mechanical resistance or spring against shell 322 that seals the interface between shell 322 and shield 320 to improve EMI performance. Each of the plurality of contact members 350 may contact conductive shell 322 on both sides of the member 350 to increase the surface area of contact to thereby improve EMI shielding. Further, in an embodiment in which shell 322 comprises conductive fibers, the plurality of contact elements 350 may catch or otherwise electrically couple to the conductive fibers in shell 322 to thereby further improve EMI shielding between shield 320 and shell 322.

Similarly, connector head 310 may also include a plurality of contact members 340 in some embodiments. Each contact member 340 may extend outwardly from connector head 310. In an embodiment, the plurality of contact members 340 may be stamped out or otherwise formed out of connector head 310. The plurality of contact members 340 may be arranged along a top face 342, a bottom face 344, or both top face 342 and bottom face 344 of connector head 310. The plurality of contact members 340 include a first plurality of cantilevered spring arms extending outwardly from the conductive shield. In an embodiment, some or all of the plurality of contact members 340 may have a substantially S-shape.

In an embodiment, shell 322 may substantially encase at least a rear portion 311A of connector head 310 including the plurality of contact members 340. Under these circumstances, contact members 340 formed along rear portion 311A of connector head 310 may extend outwardly from connector head 310 toward shell 322 to electrically couple connector head 310 to conductive shell 322 thereby electrically coupling connector head 310 to shell 322. By doing so, the plurality of contact members 340 may provide a level of mechanical resistance or spring against shell 322 to improve EMI performance. Each of the plurality of contact members 340 contacts shell 322 on both sides of the member 340 to increase the surface area of contact and improve EMI shielding. Further, in an embodiment in which shell 322 comprises conductive fibers, the plurality of contact elements 340 may catch or otherwise electrically couple to the conductive fibers in shell 322 to thereby further improve EMI shielding between connector head 310 and shell 322.

Figure 3B:
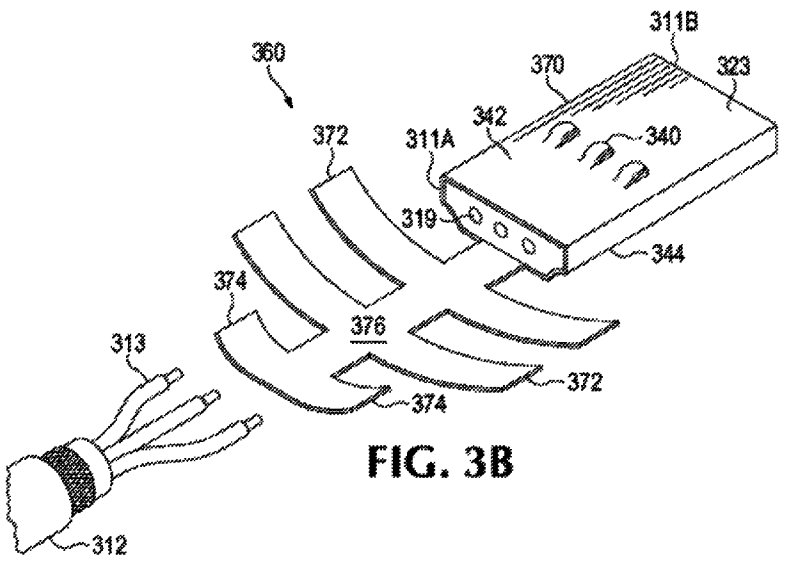
FIG. 3B is an exploded view of an embodiment of a connector head of a cable assembly according to the present disclosure.

FIG. 3B is an exploded view of an embodiment of a connector head 370 of a cable assembly 360 according to the present disclosure. Referring to FIGS. 3A and 3B, connector head 370 may include at least the functionality of connector head 310 and shield 320 in a single element. By doing so, connector head 370 may facilitate reduced cost assembly or manufacture of cable assembly 360.

Like connector head 310, connector head 370 may include a plurality of contact members 340 that extend outwardly from connector head 370. In an embodiment, the plurality of contact members 340 may be stamped out or otherwise formed out of connector head 370. At least an outer shell of connector head 370 may comprise any conductive material known to a person of ordinary skill in the art, e.g., stamped or sheet metals. Connector head 370 may have any shape appropriate for its intended application. The plurality of contact members 340 may be arranged along top face 342, bottom face 344, or both top face 342 and bottom face 344 of connector head 370. The plurality of contact members 340 include a first plurality of cantilevered spring arms extending outwardly from the conductive shield. In an embodiment, some or all of the plurality of contact members 340 may have a substantially S-shape.

In the embodiment shown in FIG. 3B, connector head 370 may have a substantially rectangular body with four sides. A center column 376 may extend from top face 342, bottom face 344, or both top face 342 and bottom face 344 of connector head 370. Center column 376 may have any dimensions appropriate for its intended application. In an embodiment, center column 376 may comprise any known conductive material, e.g., stamped or sheet metal. A plurality of ribs 372 may extend transversely from either side of center column 376. The plurality of ribs 372 may wrap around wires 313 and cable 312 during manufacture of assembly 360. In an embodiment, the plurality ribs 372 may include at least two crimping ribs 374 to crimp around wires 313 in cable 312. During manufacture of cable assembly 360, ribs 372 may be bent or otherwise manipulated around wires 313 to keep wires 313 in place and received by conductors 319 of connector head 310. Ribs 372 may provide EMI shielding while additionally providing mechanical rigidity and damage protection to cable assembly 360. Likewise, during manufacture of cable assembly 360, crimping ribs 374 may be crimped or otherwise manipulated around cable 312 to provide EMI shielding while additionally providing mechanical rigidity and damage protection to cable assembly 360.

Figure 4:
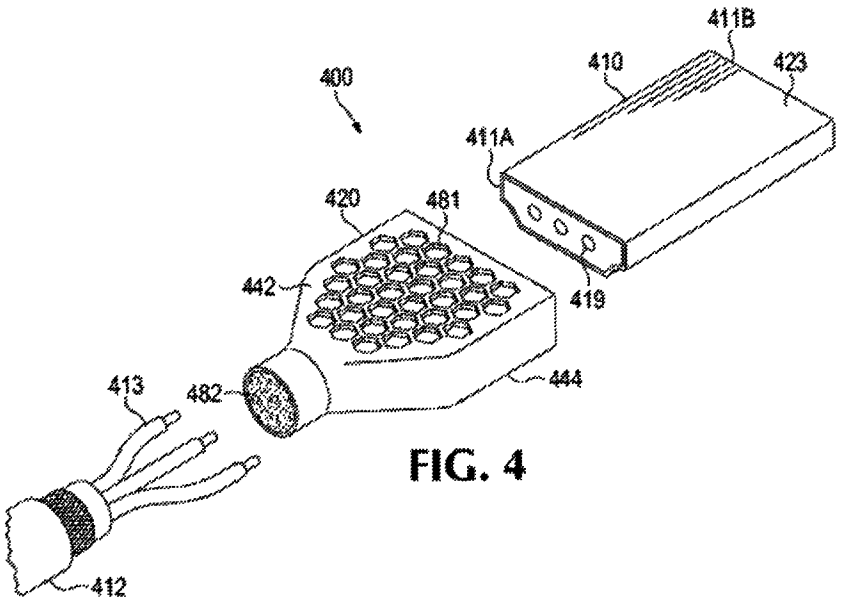
FIG. 4 is a perspective view of an embodiment of a connector shield of a cable assembly according to the present disclosure.

FIG. 4 is a perspective view of an embodiment of a shield 420 of a cable assembly 400 according to the present disclosure. Referring to FIG. 4, cable assembly 400 includes a connector head 410 having similar characteristics as connector head 210 shown in FIG. 2. Connector head 410 may include a rear portion 411A and a front portion 411B. Rear portion 411A receives a plurality of wires 413 bundled in cable 412. The number and type of wires included in the plurality of wires 413 varies based on well-known cable design parameters, including the type of interface supported by cable 412. Front portion 411B receives a mating connector, e.g., connectors 104A or 104B shown in FIG. 1. Like connector head 210, connector head 410 may include conductors 419 arranged around a top and a bottom of an opening. Connector head 410 may include a metal body 423 to provide EMI shielding and mechanical rigidity as is well known to a person of ordinary skill in the art.

Shield 420 may comprise any conductive material known to any person of ordinary skill in the art, e.g., stamped or sheet metals. Shield 420 may have any shape appropriate for its intended application, including the tapered four-sided box shown in FIG. 4.

Shield 420 may include a plurality of perforations 481 on a top face 442, bottom face 444, or top face 442 and bottom face 444. The plurality of perforations 481 may have any number and size appropriate for the intended application and may be arranged in any manner. In an embodiment, the plurality of perforations 481 may be arranged in an array of columns and rows. Each of the plurality of perforations 481 may have any shape known to a person of ordinary skill in the art, e.g., hexagonal, circular, rectangular, square, rhombic, triangular, and the like. In an embodiment, each of the plurality of perforations 481 has a substantially hexagonal shape but other shapes come within the scope of the disclosure. The plurality of perforations 481 may include differently-sized and differently-shaped perforations in a single shield 420 depending on a variety of factors, e.g., intended application, manufacturing, cost, and the like. The plurality of perforations may be formed on shield 420 in any manner known to a person of ordinary skill in the art including stamped out of sheet metal or die cast.

Instead of a shell 322, cable assembly 400 includes a conductive plastic 482 injected into the plurality of perforations 481. Conductive plastic 482 may comprise a resin or plastic having a liquid phase and a solid phase. During the liquid phase, conductive plastic 482 may be injected into the plurality of perforations 481 after shell 322 is arranged to substantially encase connector head 410 and allowed to set as conductive plastic 482 reaches its solid phase. Once in its solid phase a predetermined amount of time after the liquid phase, conductive plastic 482 sets connector head 410 in place to provide EMI shielding while additionally providing mechanical rigidity and damage protection to cable assembly 400. Conductive plastic 482 may reduce the effects of shock, vibration, or mechanical pull against the wires 413 of cable 412 internal to shield 420. Conductive plastic 482 may be any plastic or resin known to a person of ordinary skill in the art.

In an embodiment, cable assembly 400 may further include an overmold (not shown) arranged to partially encase connector head 410, shield 420, and conductive plastic 482 similar to overmold 208 shown in FIG. 2. As with overmold 208, the overmold in cable assembly 400 (not shown) may be made of any insulating material known to a person or ordinary skill in the art.

Figure 5:
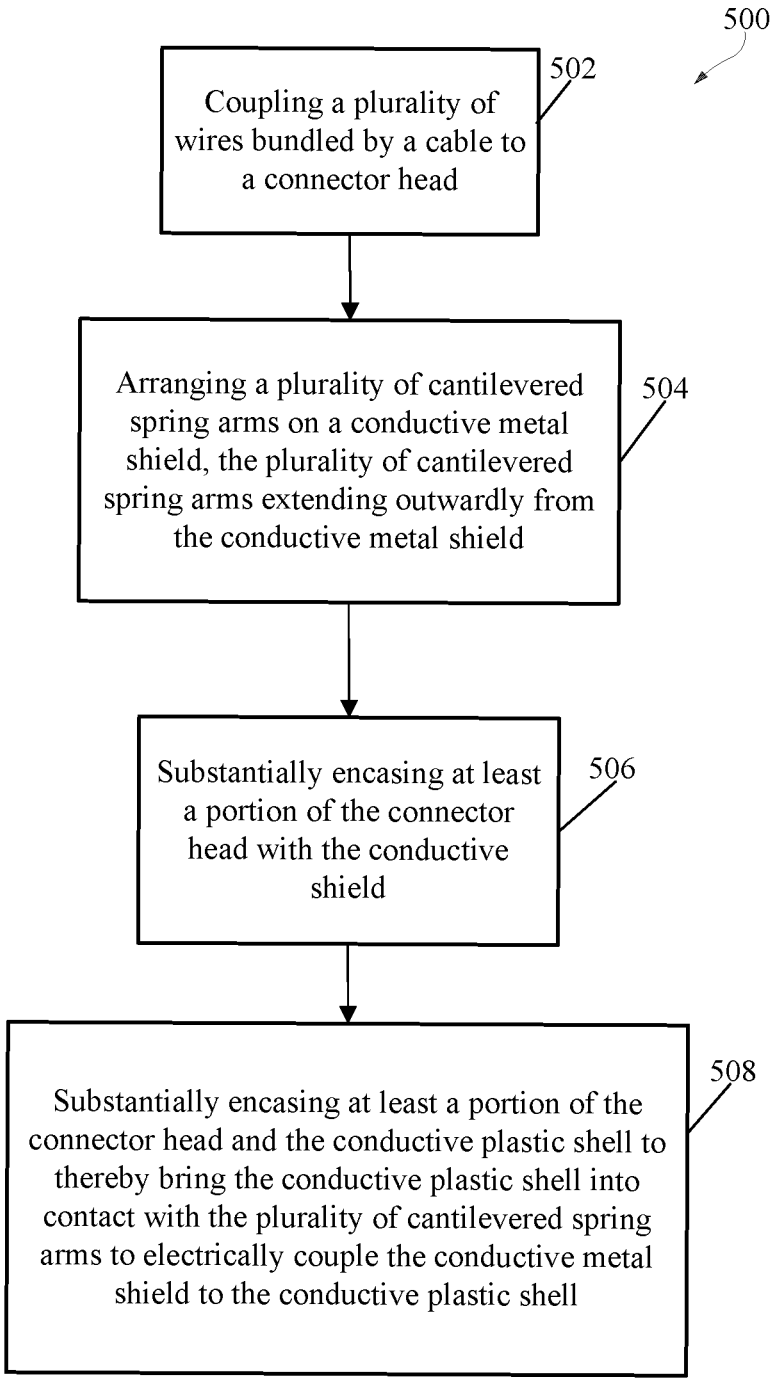
FIG. 5 is a block diagram of an embodiment of a method of manufacturing a cable assembly according to the present disclosure.

FIG. 5 is a block diagram of an embodiment of a method of manufacturing a cable assembly according to the present disclosure. Referring to FIG. 5, at 502, method 500 couples a plurality of wires bundled by a cable to a connector head. At 504, method 500 arranges a plurality of cantilevered spring arms having a substantially S-shape on a conductive metal shield, the plurality of cantilevered spring arms extending outwardly from the conductive metal shield. At 506, method 500 substantially encases at least a portion of the connector head with the conductive metal shield. At 508, method 500 substantially encases at least a portion of the connector head and the conductive metal shield with a conductive plastic shell to thereby bring the conductive plastic shell into contact with the plurality of cantilevered spring arms to electrically couple the conductive metal shield to the conductive plastic shell.

Figure 6:
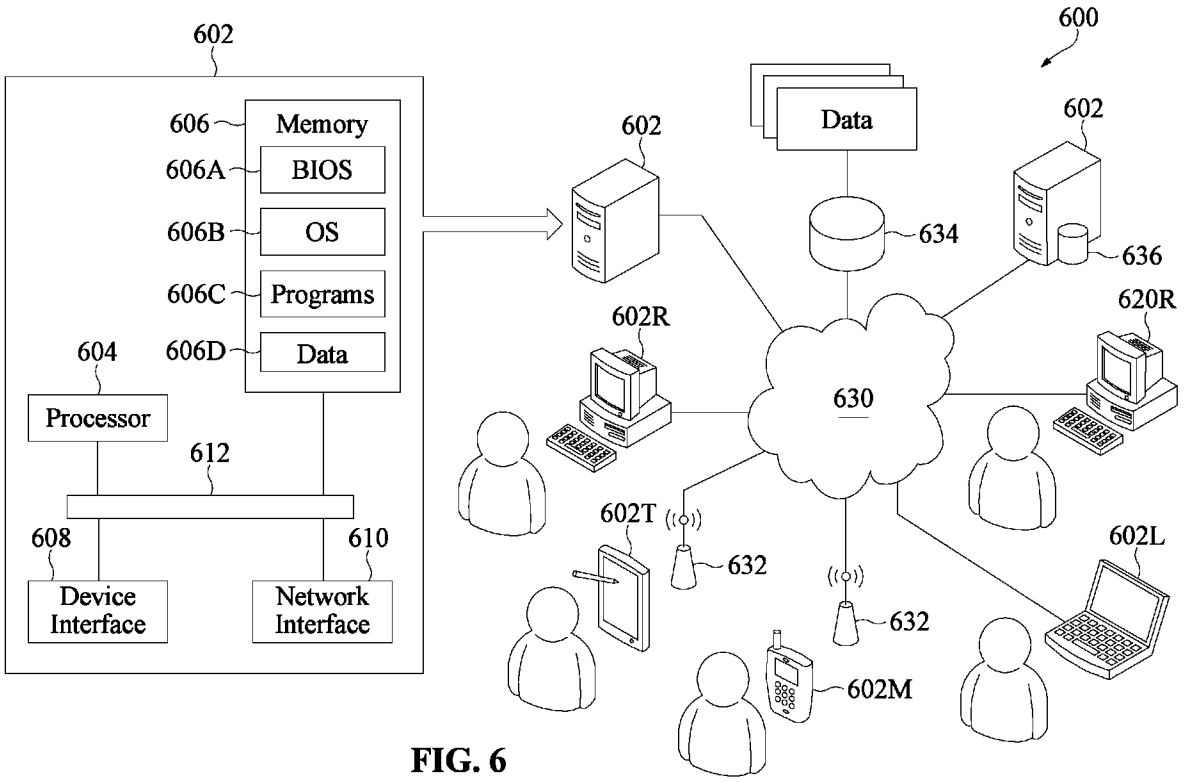
FIG. 6 is a block diagram of an embodiment of a system according to the present disclosure.

FIG. 6 is a block diagram of an embodiment of a system according to the present disclosure. Referring to FIG. 6, system 600 includes a computing device 602 that may represent electronic devices 104A or 104B coupled using cable assembly 100 shown in FIG. 1. Computing device 602 may execute instructions of application programs or modules stored in system memory, e.g., memory 606. The application programs or modules may include components, objects, routines, programs, instructions, data structures, and the like that perform particular tasks or functions or that implement particular abstract data types as discussed above. Some or all of the application programs may be instantiated at run time by a processing device 604. A person of ordinary skill in the art will recognize that many of the concepts associated with the exemplary embodiment of system 600 may be implemented as computer instructions, firmware, or software in any of a variety of computing architectures, e.g., computing device 602, to achieve a same or equivalent result.

Moreover, a person of ordinary skill in the art will recognize that the exemplary embodiment of system 600 may be implemented on other types of computing architectures, e.g., general purpose or personal computers, hand-held devices, mobile communication devices, gaming devices, music devices, photographic devices, multi-processor systems, microprocessor-based or programmable consumer electronics, minicomputers, mainframe computers, application specific integrated circuits, and like. For illustrative purposes only, system 600 is shown in FIG. 6 to include computing devices 602, geographically remote computing devices 602R, tablet computing device 602T, mobile computing device 602M, and laptop computing device 602L. A person of ordinary skill in the art may recognize that computing device 602 may be embodied in any of tablet computing device 602T, mobile computing device 602M, or laptop computing device 602L. Mobile computing device 602M may include mobile cellular devices, mobile gaming devices, mobile reader devices, mobile photographic devices, and the like.

A person of ordinary skill in the art will recognize that an exemplary embodiment of system 600 may be implemented in a distributed computing system in which various computing entities or devices, often geographically remote from one another, e.g., computing device 602 and remote computing device 602R, perform particular tasks or execute particular objects, components, routines, programs, instructions, data structures, and the like. For example, the exemplary embodiment of system 600 may be implemented in a server/client configuration (e.g., computing device 602 may operate as a server and remote computing device 602R may operate as a client). In distributed computing systems, application programs may be stored in local memory 606, external memory 636, or remote memory 634. Local memory 606, external memory 636, or remote memory 634 may be any kind of memory, volatile or non-volatile, removable or non-removable, known to a person of ordinary skill in the art including random access memory (RAM), flash memory, read only memory (ROM), ferroelectric RAM, magnetic storage devices, optical discs, and the like.

The computing device 602 comprises processing device 604, memory 606, device interface 608, and network interface 610, which may all be interconnected through bus 612. The processing device 604 represents a single, central processing unit, or a plurality of processing units in a single or two or more computing devices 602, e.g., computing device 602 and remote computing device 602R. The local memory 606, as well as external memory 636 or remote memory 634, may be any type memory device known to a person of ordinary skill in the art including any combination of RAM, flash memory, ROM, ferroelectric RAM, magnetic storage devices, optical discs, and the like. The local memory 606 may store a basic input/output system (BIOS) 606A with routines executable by processing device 604 to transfer data, including data 606D, between the various elements of system 600. The local memory 606 also may store an operating system (OS) 606B executable by processing device 604 that, after being initially loaded by a boot program, manages other programs in the computing device 602. Memory 606 may store routines or programs executable by processing device 604, e.g., applications or programs 606C. Applications or programs 606C may make use of the OS 606B by making requests for services through a defined application program interface (API). Applications or programs 606C may be used to enable the generation or creation of any application program designed to perform a specific function directly for a user or, in some cases, for another application program. Examples of application programs include word processors, database programs, browsers, development tools, drawing, paint, and image editing programs, communication programs, and tailored applications as the present disclosure describes in more detail, and the like. Users may interact directly with computing device 602 through a user interface such as a command language or a user interface displayed on a monitor (not shown).

Device interface 608 may be any one of several types of interfaces. The device interface 608 may operatively couple any of a variety of devices, e.g., hard disk drive, optical disk drive, magnetic disk drive, or the like, to the bus 612. The device interface 608 may represent either one interface or various distinct interfaces, each specially constructed to support the particular device that it interfaces to the bus 612. The device interface 608 may additionally interface input or output devices utilized by a user to provide direction to the computing device 602 and to receive information from the computing device 602. These input or output devices may include voice recognition devices, gesture recognition devices, touch recognition devices, keyboards, monitors, mice, pointing devices, speakers, stylus, microphone, joystick, game pad, satellite dish, printer, scanner, camera, video equipment, modem, monitor, and the like (not shown). The device interface 608 may be a serial interface, parallel port, game port, Firewire port, universal serial bus, or the like.

A person of ordinary skill in the art will recognize that the system 600 may use any type of computer readable medium accessible by a computer, such as magnetic cassettes, flash memory cards, compact discs (CDs), digital video disks (DVDs), cartridges, RAM, ROM, flash memory, magnetic disc drives, optical disc drives, and the like. A computer readable medium as described herein includes any manner of computer program product, computer storage, machine readable storage, or the like.

Network interface 610 operatively couples the computing device 602 to one or more remote computing devices 602R, tablet computing devices 602T, mobile computing devices 602M, and laptop computing devices 602L, on a local, wide, or global area network 630. Computing devices 602R may be geographically remote from computing device 602. Remote computing device 602R may have the structure of computing device 602, or may operate as server, client, router, switch, peer device, network node, or other networked device and typically includes some or all of the elements of computing device 602. Computing device 602 may connect to network 630 through a network interface or adapter included in the interface 610. Computing device 602 may connect to network 630 through a modem or other communications device included in the network interface 610. Computing device 602 alternatively may connect to network 630 using a wireless device 632. The modem or communications device may establish communications to remote computing devices 602R through global communications network 630. A person of ordinary skill in the art will recognize that applications or programs 606C might be stored remotely through such networked connections. Network 630 may be local, wide, global, or otherwise and may include wired or wireless connections employing electrical, optical, electromagnetic, acoustic, or other carriers.

The present disclosure may describe some portions of the exemplary system using algorithms and symbolic representations of operations on data bits within a memory, e.g., memory 606. A person of ordinary skill in the art will understand these algorithms and symbolic representations as most effectively conveying the substance of their work to others of ordinary skill in the art. An algorithm is a self-consistent sequence leading to a desired result. The sequence requires physical manipulations of physical quantities. Usually, but not necessarily, these quantities take the form of electrical or magnetic signals capable of being stored, transferred, combined, compared, and otherwise manipulated. For simplicity, the present disclosure refers to these signals as bits, values, elements, symbols, characters, terms, numbers, or like. The terms are merely convenient labels. A person of skill in the art will recognize that terms such as computing, calculating, generating, loading, determining, displaying, or like refer to the actions and processes of a computing device, e.g., computing device 602. The computing device 602 may manipulate and transform data represented as physical electronic quantities within a memory into other data similarly represented as physical electronic quantities within the memory.

It will also be appreciated by persons of ordinary skill in the art that the present disclosure is not limited to what has been particularly shown and described hereinabove. Rather, the scope of the present disclosure includes both combinations and sub-combinations of the various features described hereinabove as well as modifications and variations which would occur to such skilled persons upon reading the foregoing description. Thus the disclosure is limited only by the appended claims.

The invention claimed is:

1. A cable assembly, comprising:

a conductive shield having a first plurality of contact members; and a conductive shell arranged to at least partially encase the conductive shield; and a connector head;

wherein each of the first plurality of contact members extends outwardly from a top surface of the conductive shield toward a top surface of the conductive shell to electrically couple the conductive shield to the conductive shell through electrical conductive contact between each of the first plurality of contact members and the top surface of the conductive shell;

wherein the conductive shell is further arranged to at least partially encase the connector head and the conductive shield; and wherein the connector head includes a second plurality of contact members extending outwardly from a top surface of the connector head toward a top surface of the conductive shell to electrically couple the connector head to the conductive shell.

2. The cable assembly of claim 1, wherein the connector head includes:

a rear portion to receive a plurality of wires from a cable; and a front portion to receive a mating connector.

3. The cable assembly of claim 1, wherein the conductive shield comprises metal.

4. The cable assembly of claim 3, wherein each of the first plurality of contact members extends lengthwise along a top face, a bottom face, or both the top face and the bottom face of the conductive shield.

5. The cable assembly of claim 4, wherein the conductive shell comprises a conductive plastic with conductive fibers; and wherein each of the first plurality of contact members contacts the conductive fibers of the conductive shell to electrically couple the conductive shield to the conductive shell.

6. The cable assembly of claim 1, wherein the first plurality of contact members include a first plurality of cantilevered spring arms extending outwardly from the conductive shield.

7. The cable assembly of claim 6, wherein each of the first plurality of cantilevered spring arms have an S-shape.

8. The cable assembly of claim 1, further comprising:

an overmold comprising an insulating material arranged to at least partially encase the connector head, the conductive shield, and the conductive shell.

9. The cable assembly of claim 1, wherein the conductive shield further comprises:

a center column extending outwardly from the conductive shield; and a plurality of ribs extending transversely from either side of the center column and arranged to wrap around a cable.

10. The cable assembly of claim 9, wherein the plurality ribs includes at least two crimping ribs arranged to crimp around wires bundled by the cable.

11. The cable assembly of claim 9, wherein the conductive shell is further arranged to at least partially encase the conductive shield, the center column, and the plurality of ribs.

12. A cable assembly, comprising:

a connector head;

a conductive shield having a plurality of perforations on a top face; and a conductive plastic having a first liquid phase during which the conductive plastic is substantially liquid and a second solid phase during which the conductive plastic is substantially solid;

wherein the conductive shield is arranged to receive the conductive plastic during the first liquid phase through the plurality of perforations and to allow the conductive plastic to set to the second solid phase; and wherein the conductive shield is arranged to at least partially encase the connector head and the conductive plastic during the second solid phase.

13. The cable assembly of claim 12, wherein the conductive plastic sets the connector head in place during the second solid phase a predetermined amount of time after the first liquid phase.

14. The cable assembly of claim 13, further comprising:

wherein the conductive shield partially encasing the connector head and the conductive plastic during the second solid phase is arranged to reduce shock, vibration, or mechanical pull against wires or cable internal to the conductive shield.

15. The cable assembly of claim 12, wherein each of the plurality of perforations includes a substantially hexagonal, circular, triangular, rectangular, square, or rhombic shape.

16. The cable assembly of claim 12, wherein the connector head includes:

a rear portion to receive a plurality of wires from a cable; and a front portion to receive a mating connector.

17. The cable assembly of claim 12, wherein the conductive plastic comprises conductive fibers.

18. A method, comprising:

coupling a plurality of wires bundled by a cable to a connector head;

arranging a plurality of cantilevered spring arms having a substantially S-shape on a conductive metal shield, the plurality of cantilevered spring arms extending outwardly from a top surface of the conductive metal shield;

substantially encasing at least a portion of the connector head with the conductive metal shield;

substantially encasing at least a portion of the connector head and the conductive metal shield with a conductive plastic shell to thereby bring a top surface of the conductive plastic shell into contact with the plurality of cantilevered spring arms to electrically couple the conductive metal shield to the conductive plastic shell.

* * * * *